US007527483B1

(12) United States Patent
Glauber

(10) Patent No.: US 7,527,483 B1
(45) Date of Patent: May 5, 2009

(54) EXPANSIBLE CHAMBER PNEUMATIC SYSTEM

(76) Inventor: Carl J Glauber, 5825 Invincible Dr., Jamesville, NY (US) 13078

( * ) Notice: Subject to any disclaimer, the term of this patent is extended or adjusted under 35 U.S.C. 154(b) by 641 days.

(21) Appl. No.: 11/218,216

(22) Filed: Sep. 2, 2005

Related U.S. Application Data

(60) Provisional application No. 60/629,097, filed on Nov. 18, 2004.

(51) Int. Cl.
*F04B 43/06* (2006.01)

(52) U.S. Cl. ..... 417/395; 417/382; 417/404; 417/267; 417/437; 91/314; 91/307; 92/48

(58) Field of Classification Search ..... 417/487, 417/393–395, 118, 121, 320, 251, 340–347, 417/382, 64, 65, 404, 488, 384, 561, 535, 417/536, 267; 92/48–50; 91/439, 440, 314, 91/313, 307, 287
See application file for complete search history.

(56) References Cited

U.S. PATENT DOCUMENTS

| | | | | | |
|---|---|---|---|---|---|
| 1,920,014 | A * | 7/1933 | Horton et al. | 417/393 |
| 2,644,401 | A * | 7/1953 | Ragland | 417/344 |
| 3,077,186 | A * | 2/1963 | De Beaubien et al. | 91/178 |
| 3,630,642 | A * | 12/1971 | Osterman | 417/65 |
| 3,838,946 | A * | 10/1974 | Schall | 417/395 |
| 4,087,209 | A * | 5/1978 | Mahig et al. | 417/268 |
| 4,354,806 | A * | 10/1982 | McMillin et al. | 417/393 |
| 4,386,888 | A * | 6/1983 | Verley | 417/393 |
| 4,390,325 | A * | 6/1983 | Elo et al. | 417/379 |
| 4,494,912 | A * | 1/1985 | Pauliukonis | 417/347 |
| 4,496,294 | A * | 1/1985 | Frikker | 417/393 |
| 4,502,848 | A * | 3/1985 | Robertson et al. | 417/380 |
| 4,830,586 | A * | 5/1989 | Herter et al. | 417/395 |
| 5,007,812 | A * | 4/1991 | Hartt | 417/534 |
| 5,249,502 | A * | 10/1993 | Radocaj | 91/173 |
| 5,269,811 | A * | 12/1993 | Hayes et al. | 623/3.24 |
| 5,279,504 | A * | 1/1994 | Williams | 417/393 |
| 5,332,372 | A * | 7/1994 | Reynolds | 417/393 |
| 5,378,122 | A * | 1/1995 | Duncan | 417/395 |
| 5,542,336 | A * | 8/1996 | Larkin | 91/166 |
| 5,558,506 | A * | 9/1996 | Simmons et al. | 417/393 |
| 5,616,005 | A * | 4/1997 | Whitehead | 417/46 |
| 5,819,533 | A * | 10/1998 | Moonen | 60/413 |
| 6,036,445 | A * | 3/2000 | Reynolds | 417/53 |
| 6,105,829 | A * | 8/2000 | Snodgrass et al. | 222/214 |
| 6,210,131 | B1 * | 4/2001 | Whitehead | 417/397 |
| 6,685,443 | B2 * | 2/2004 | Simmons et al. | 417/395 |
| 7,107,767 | B2 * | 9/2006 | Frazer et al. | 60/414 |
| 7,212,228 | B2 * | 5/2007 | Utsumi et al. | 348/139 |
| 2001/0048882 | A1 * | 12/2001 | Layman | 417/395 |

* cited by examiner

*Primary Examiner*—Devon C Kramer
*Assistant Examiner*—Amene S Bayou
(74) *Attorney, Agent, or Firm*—Robert J. Bird

(57) ABSTRACT

An expansible chamber pneumatic system, for example a fluid pump system, includes two or more double-acting diaphragm pumps, each with symmetrical left and right pump housings, each housing including an air chamber and a fluid chamber separated by a movable diaphragm. The diaphragms are connected for reciprocating movement in unison to pump fluid through their respective fluid chambers. Each pump includes an air valve actuated by Control air to direct Process air into one of the air chambers, simultaneously releasing used Process air from the other air chamber to thereby move the diaphragms, thereby to pump fluid. A pilot valve directs Control air to the air valve to position the air valve. The pilot valve is responsive to diaphragms reaching their travel limit in one direction to direct Control air to reverse the directions of Process air flow through the air valve to thereby reverse the movement of the pump diaphragms. Control air exhausts through the pilot valve to atmosphere. Process air exhausts through the air valve from one pump to become input or motive air for the next pump.

5 Claims, 6 Drawing Sheets

EXPANSIBLE CHAMBER PNEUMATIC SYSTEM

CROSS-REFERENCE TO RELATED APPLICATION

My related Provisional Patent Application No. 60/629,097 was filed on Nov. 18, 2004. That filing date is claimed for this application.

BACKGROUND OF THE INVENTION

High pressure shop air, or "HP air" is typically at about 125 psig pressure. Air is pressurized in a compressor and stored in a tank for operation in a range of, typically, 115 to 125 psig. HP air from the tank is piped throughout the plant as motive air for pneumatic equipment, or as pressurized air for purposes such as spraying or cleaning. While "high pressure" has to be high enough to meet all pressure requirements, some equipment operates at pressures lower than the "high pressure" level. For such lower pressure applications, a pressure reducing valve is required upstream of the equipment to reduce the pressure input to such equipment. A pressure reducing valve is a modulating orifice which allows high pressure air to expand to a lower pressure.

The problem with prior art systems as just described is that HP air is being wasted by putting it through a reducing valve to lower its pressure, wasting also the energy used to generate the HP air in the first place.

Factories often use many and various types of air driven equipment with varying requirements of air pressure and flow rate. The compressor and associated air tank are sized to meet the total pressure and volume requirements of all the pneumatic equipment in the factory. Pneumatic equipment typically takes in input air (or "Motive" air), and divides it into "Control" air and "Process" air. Control air controls equipment operation. Process air does the work. In an air-operated diaphragm pump, Control air operates an air direction control (DC) valve. The DC valve, in turn, directs Process air to drive the pump's diaphragm to thereby pump fluid. Control air and Process air then recombine, and together they exhaust from the pump to atmosphere.

It is an industry rule of thumb that a 2 psi change of output pressure corresponds with a 1% change of power required to generate it. Thus, the above-described reduction of HP air pressure from 125 psig to, say, 75 psig (a 50 psi reduction) represents a waste of 25% of the power required to generate it. In other words, 25% less power is required to compress air to 75 psig than is required to compress air to 125 psig. Another industry standard which will come into play here is that one horsepower is required to compress 4 cfm to 100 psig (i.e. 4 cfm/hp).

In addition to the term "high pressure" (HP), the terms "intermediate pressure" (IP) and "low pressure" (LP) may also be used herein, abbreviated as just indicated.

Pumps of the type described here are disclosed in U.S. Pat. No. 4,247,264 to Wilden.

SUMMARY OF THE INVENTION

In summary, this invention is an expansible chamber pneumatic system, for example a fluid pump system, including two or more double-acting diaphragm pumps (or one pump utilizing Process air more than once), each with symmetrical left and right pump housings, each housing including an air chamber and a fluid chamber separated by a movable diaphragm. The diaphragms are connected for reciprocating movement in unison to pump fluid through their respective fluid chambers. Each pump includes an air direction control (DC) valve actuated by Control air to direct Process air alternately into right and left air chambers, simultaneously releasing used Process air from the other air chamber to thereby move the pistons to pump fluid. A pilot valve is responsive to pistons reaching their travel limits to direct Control air to the DC valve, alternating the directions of Process air flow through the DC valve to reverse the movement of the pump pistons. Control air exhausts through the pilot valve to atmosphere. Process air exhausts through the DC valve from one pump to become input or motive air for the next pump.

More broadly, this invention is an expansible chamber pneumatic system, including a first air-operated device with separate left and right units each including an air chamber and a reciprocally movable piston. The pistons are connected to a common rod for reciprocating movement in unison. An air direction control (DC) valve directs Process air to one air chamber, simultaneously exhausting Process air from the other air chamber, thereby moving the pistons in a first direction. A pilot valve is responsive to pistons reaching their travel limits to direct Control air to the DC valve, alternating the directions of Process air flow through the DC valve to reverse the movement of the pistons. Control air exhausts through the pilot valve to atmosphere. Process air exhausts through the DC valve from one air-operated device to become input or motive air for a second such air-operated device.

DRAWING

DESCRIPTION OF THE INVENTION

Figure 1:
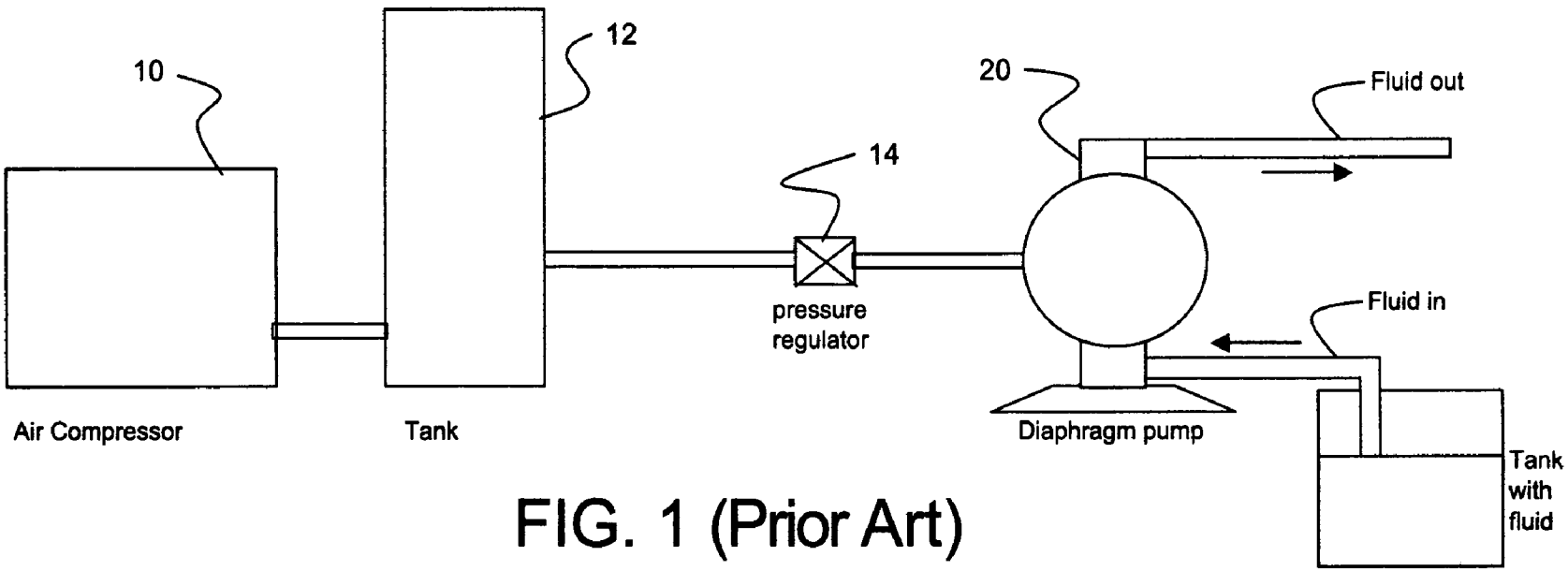
FIG. 1 (Prior Art)
FIG. 1 is a diagram of a typical prior art expansible chamber (diaphragm) pump system.

FIG. 1 represents a prior art system in which a compressor 10 delivers 100 psig air to a tank 12, and is distributed from the tank 12 through plant piping. A diaphragm pump 20 requires input or motive air at 50 psig. A pressure regulator 14 upstream of the pump 20 reduces the motive air pressure from 100 psig to 50 psig to operate the pump 20. To the extent that motive air is distributed to pump(s) 20, 25% of the compressor energy put into that quantity of air is wasted.

Figure 2:
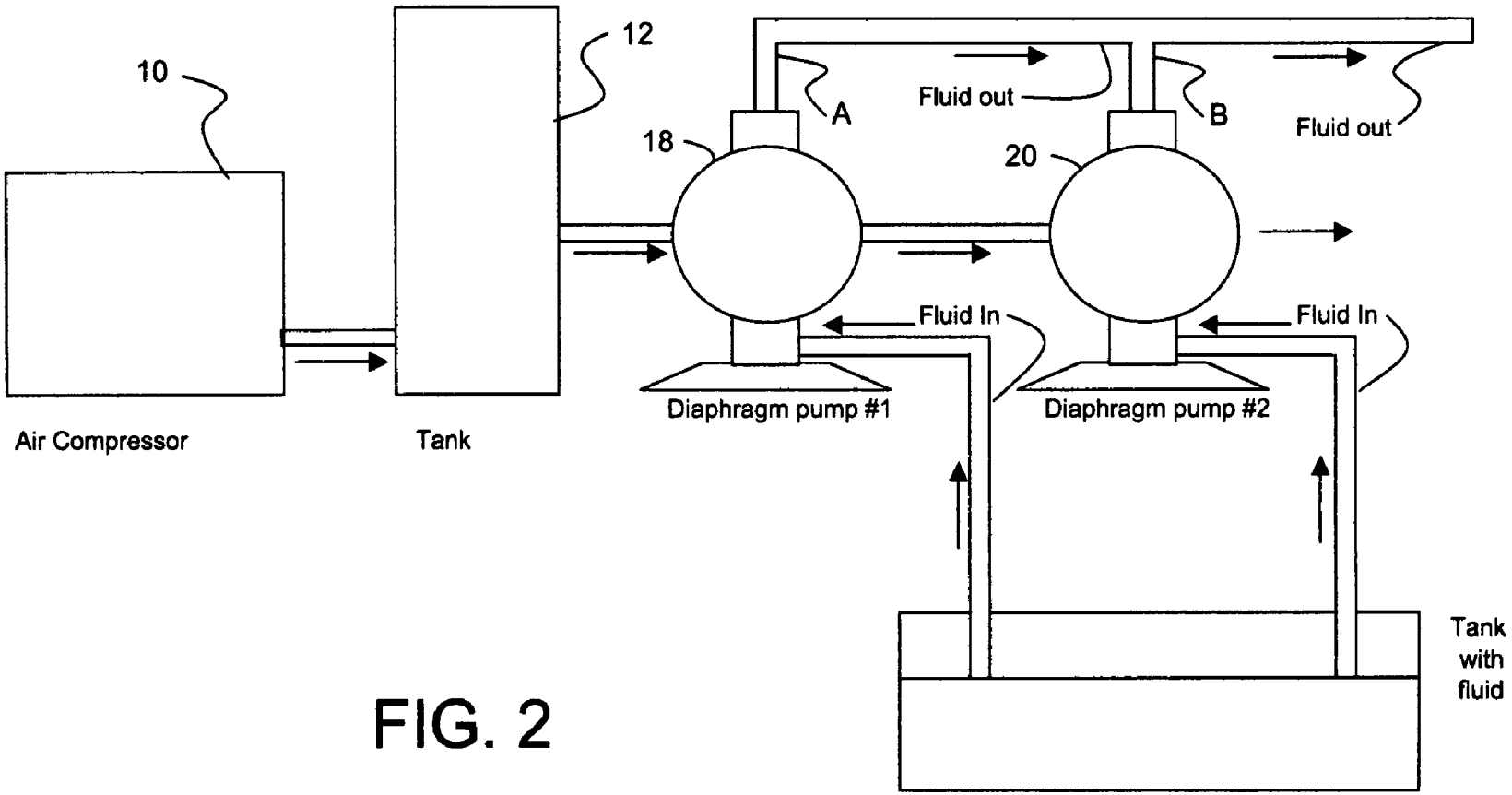
FIG. 2 is a similar diagram of an expansible chamber pump system of this invention.

In FIG. 2, the system of this invention includes a compressor 10, tank 12, a first diaphragm pump 18, and a second diaphragm pump 20. (Unlike the prior art system of FIG. 1, the FIG. 2 system of this invention does not include a pressure regulator). The pumps 18, 20 are pneumatically connected in series. HP motive air enters pump 18 at 100 psig to produce output fluid flow A. Process air exhausted from pump 18 at 50 psig enters pump 20 as motive air. Pump 20 in turn generates fluid flow B, exhausts its Process air to atmosphere. The pumps 18, 20 are hydraulically connected in parallel; i.e. liquid is pumped from them in separate paths. In this system, HP air energy, which would have been wasted in a regulator, is instead used to drive pump 18.

Figure 3:
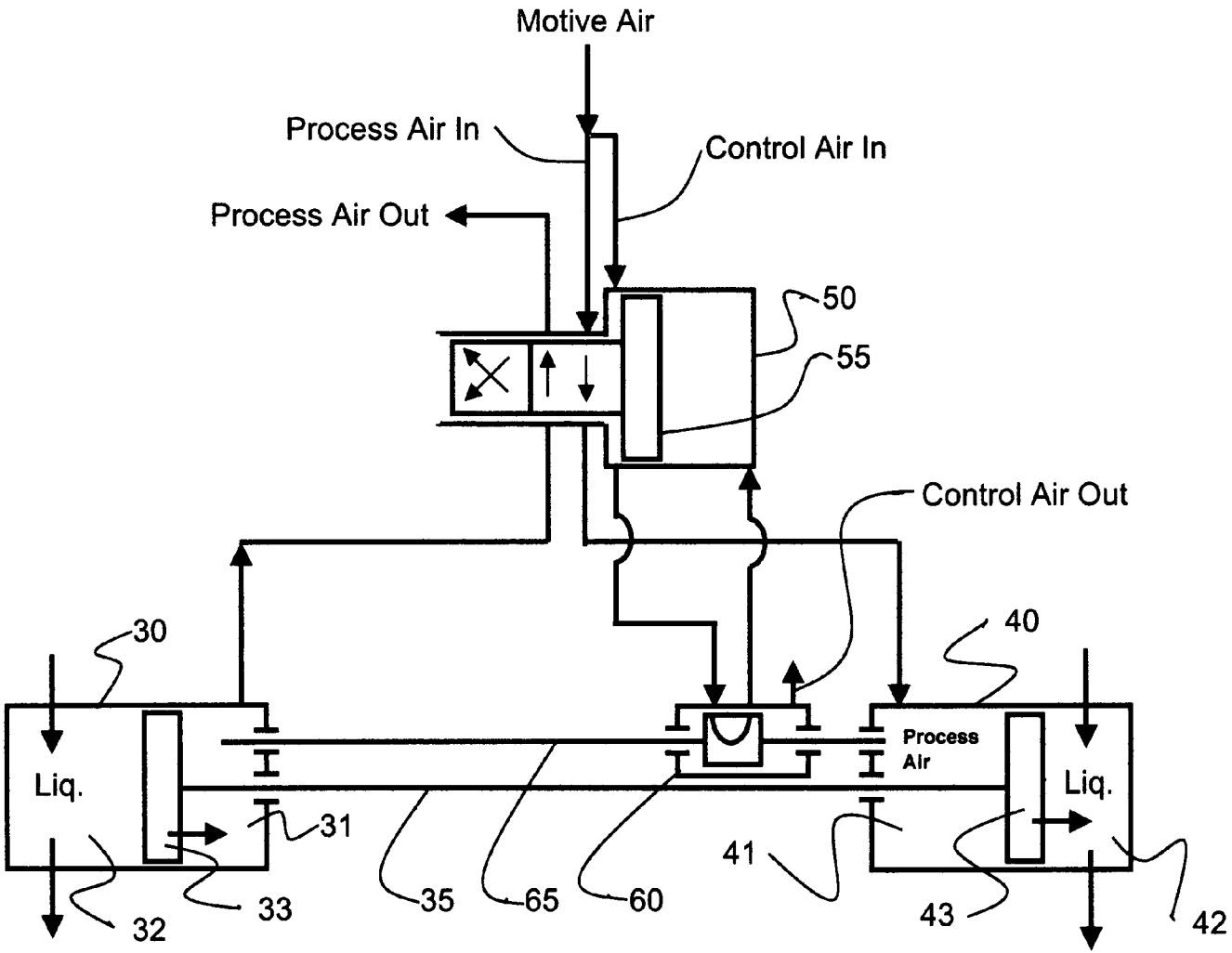
FIG. 3 is a schematic diagram of part of the system of FIG. 2.

FIG. 3 is a schematic diagram of one of the pumps (18) from FIG. 2 to simplify an understanding of this invention. (Similar components are similarly numbered). The pump 18 includes symmetrical left and right pump housings 30, 40. The left housing 30 includes an air chamber 31 on its inner end, a liquid chamber 32 on its outer end, and a movable pump piston 33 separating the two chambers. The right housing 40 similarly includes an air chamber 41 on its inner end, a liquid chamber 42 on its outer end, and a movable pump piston 43 separating the two chambers. The pistons 33, 43, which reciprocate in their respective housings, are connected by a connecting rod 35 for reciprocating movement in unison.

Motive air enters the pump. A small amount (<1%) is diverted as Control air into an air Direction Control (DC) valve 50. The rest (>99%) is Process air to perform work. Control air acts against a piston 55 in the DC valve 50 to direct Process air alternately to the right air chamber 41, then to left air chamber 31, then to right air chamber 41, and so on, continuously.

In FIG. 3, Control air has moved the DC valve piston 55 to the left. In this condition, the DC valve 50 (i) directs Process air to the right air chamber 41, moving the piston 43 to the right to pump fluid from liquid chamber 42, and (ii) directs Process air exhausted from the left air chamber 31 to the next pump 20 as motive air.

The DC valve 50 directs Process air alternately to right and left air chambers 41, 31, as determined by, respectively, left and right positions of the piston 55 in the DC valve 50. Alternating left/right positions of the piston 55 are, in turn, controlled by Control air directed from a pilot valve 60. Pilot valve 60 is alternately positioned in response to alternating directional movements of pistons 33, 43 by means of a pilot actuator rod 65.

From their positions shown in FIG. 3, as the pistons 33, 43 move to the right, piston 33 abuts the pilot rod 65 to move the pilot valve 60 to the right, from the position shown to one in which the pilot valve exhausts Control air to atmosphere (FIG. 3, Control Air Out). Piston 55 in the DC valve 50 then moves to the right. In this condition, the DC valve 50 (i) directs Process air to the left air chamber 31, moving the piston 33 to the left to pump fluid from liquid chamber 32, and (ii) directs Process air exhausted from the right air chamber 41 to the next pump 20 as motive air.

Figure 4:
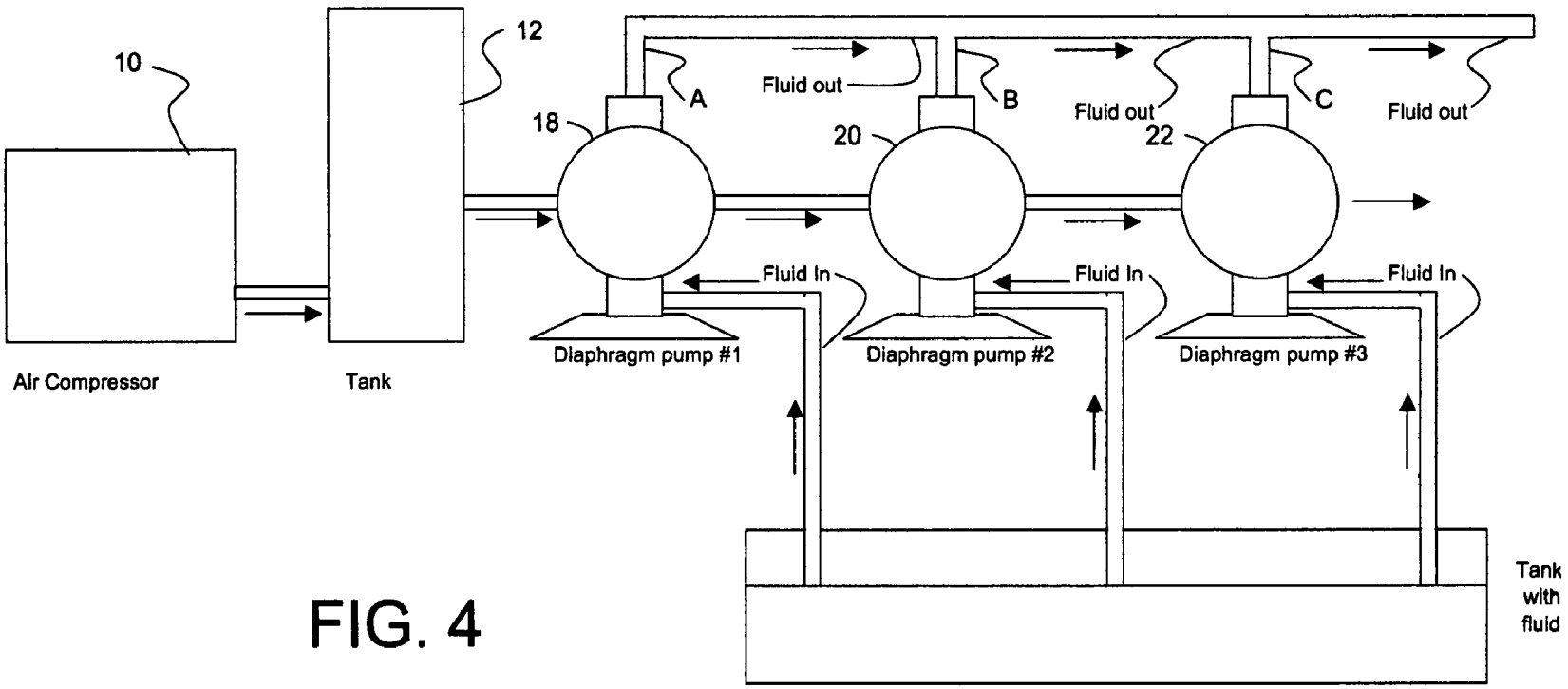
FIG. 4 is a diagram of a pump system of this invention for a given example.

As an example, consider a system that requires output fluid flow of 104 gpm at 20 psig. To meet that requirement, a prior art single-pump system (FIG. 1) requires compressed air at 60 psig and 60 scfm. In a series pump system of this invention (FIG. 4), using full shop air pressure, three smaller pumps will meet the same system requirement.

Each pump is required to produce 35 gpm (104 gpm/3 pumps) at 20 psig. Performance curves for the smaller pump shows air pressure requirement of 40 psig and air volume requirement of 15 scfm. Shop air pressure is 120 psig. Motive pressure differential (ΔP) across each pump is 40 psig.

Motive air enters the first pump 18 at 120 psig. The Process air portion of it leaves the pump at 80 psig to enter the second pump 20. Process air exhausted from the pump 18 becomes motive air entering the second pump 20 at 80 psig. The Process air portion of that air leaves the pump 20 to enter a third pump 22 at 40 psig, from which it exhausts to atmosphere. The three pumps generate separate fluid flows A, B, C.

Total required airflow (scfm) is less than in the above single pump system because the body of motive air input to the system is expanded three times over to produce the same fluid flow. In the three pump example, air usage is approximately 20 scfm (vs. 60 scfm in the single pump) to do the same job! This equates to 40 scfm in saved compressed airflow or 10 hp savings in brake horsepower (40 scfm/4 scfm per bhp=10 bhp).

Figure 5:
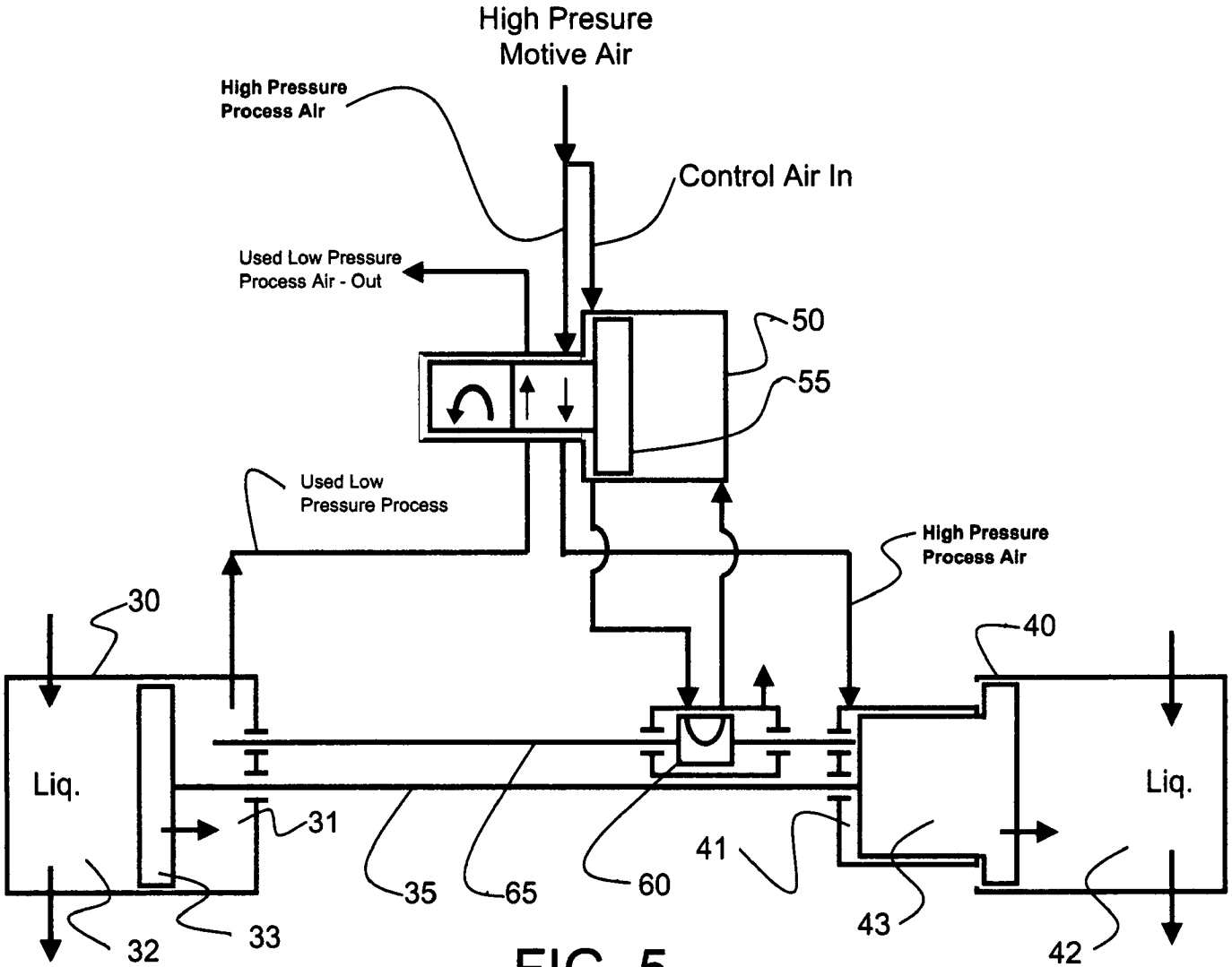
FIGS. 5, 6 are schematic diagrams of a pump system in another form of this invention.
Figure 6:
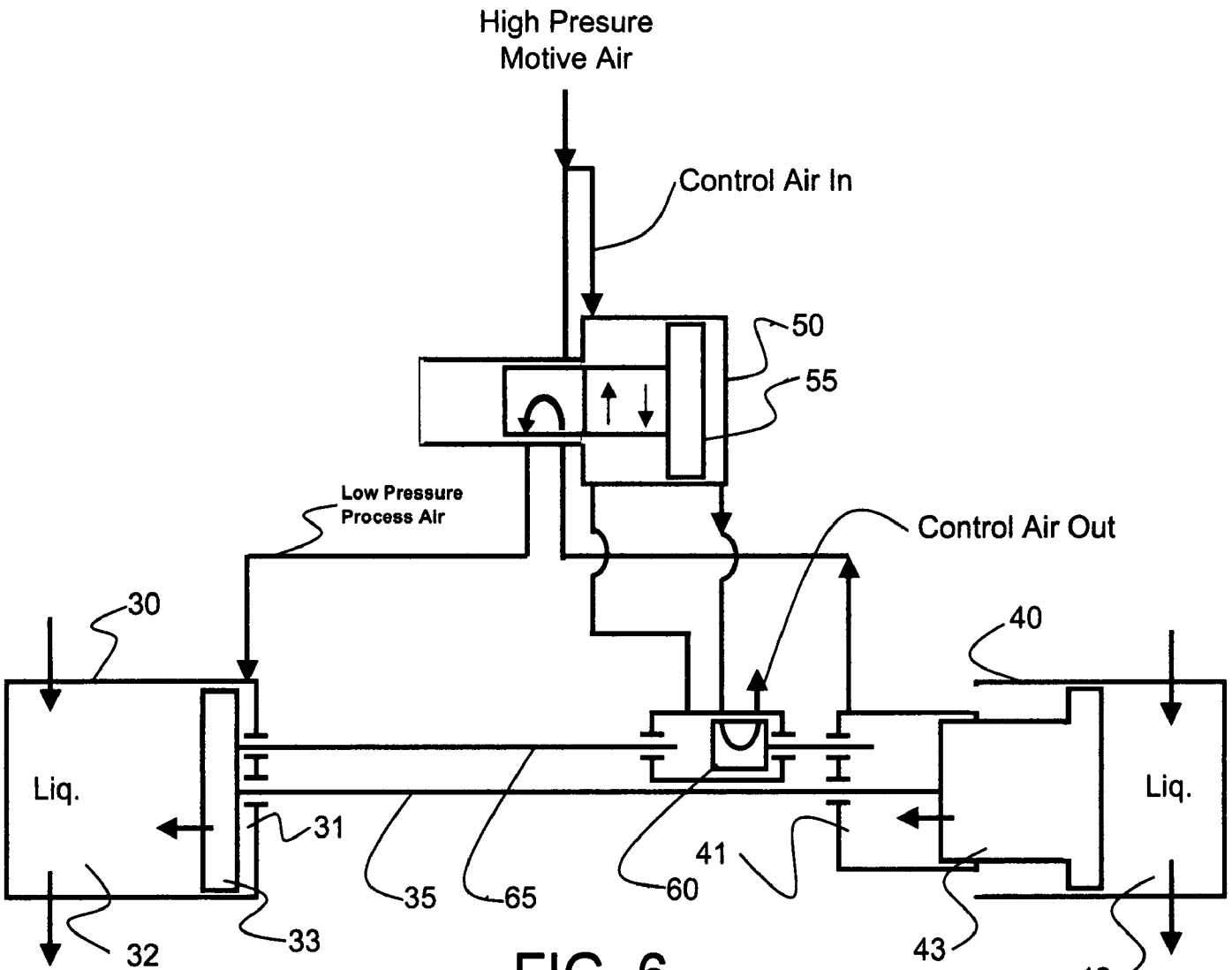

FIGS. 5, 6 are diagrams of another form of this invention, a two-stage pump in which one stage uses Process air at a higher pressure than the other. The first stage exhausts to the second stage. Motive air enters the pump as in FIG. 3. A small amount (<1%) is diverted as Control air to the DC valve 50. The rest (>99%) is Process air to do work. Control air acts against piston 55 in the DC valve 50 to direct Process air alternately to right and left air chambers 41, 31. In FIG. 5, the DC valve is- directing input HP Process air into chamber 41 against the piston 43, and venting used (twice-expanded) Process air from chamber 31 to atmosphere. Piston 43 moves right to pump liquid from the chamber 42. Piston 33 also moves right to draw liquid into chamber 32.

In FIG. 6, the piston 33 abuts the pilot shaft 65 to move the pilot valve 60 to the right. This releases Control air from the DC valve 50 and moves the valve piston 55 to the right. The DC valve 50 now connects chamber 41 with chamber 31, directing once-expanded (Intermediate Pressure) Process air from chamber 41 to chamber 31. Piston 33, larger in area than piston 43, moves to the left to pump liquid from the chamber 32. Piston 43 also moves left to draw liquid into the chamber 42. When the piston 43 abuts the pilot shaft 65, the pilot valve 60 moves left to direct Control air back to the DC valve 50 and against the piston 55, moving the piston 55 to the left. The cycle starts all over again.

Benefits of this invention, vis a vis a standard single-pump system, are as follows: It produces increased output fluid flow per unit of input air. It significantly reduces air volume requirement and energy consumption. It reduces the possibility of freeze-up from compressed air expansion because it reduces pressure differential and air volume in the pump units. It reduces airflow friction loss due to reduced volume of free air moving through air pipelines. There is less wear on an individual pump because of reduced fluid flow, reduced pressure differential, and reduced air volume per pump.

In this invention, unlike the prior art, motive air is not pressure-reduced, then used once, then wasted to atmosphere. It is not the pressure level but the pressure drop (ΔP) across the equipment that matters. As illustrated in the foregoing example, the ΔP is 40 psi. That being the case, it can be better appreciated how and why the present invention, with a plurality of pumps and their air sides connected in series, the pumps use motive air in stages, thus to extract as much as possible of the available energy in the HP air supply.

Although some expansible chamber devices to which this invention relates have diaphragms instead of pistons, for simplicity of illustration the prime movers of the system are shown and described as pistons. Pistons and diaphragms are, for present purposes, hydraulically and pneumatically equivalent, so distinctions between them are immaterial here. The term "piston" in the following claims includes "diaphragm".

Terms indicative of orientation are hot intended as limitations but as description with reference to the drawings. Described structure retains its character whether oriented as shown or otherwise. Any details as to materials, quantities, dimensions, and the like are intended as illustrative.

The foregoing description of a preferred embodiment is illustrative of the invention. The concept and scope of the invention are, however, limited not by the details of that description but only by the following claims and equivalents thereof.

What is claimed is:

1. A pneumatic system of expansible chamber devices pneumatically connected in series, said system including:

high-pressure (HP) and low pressure (LP) air chambers, each with and a piston movable therein;

said pistons connected to a common rod for reciprocating movement in unison;

an air direction control valve (50) disposed to receive input HP process air, said direction control valve operable alternately in first and second valve conditions;

in said first condition (FIG. 5), said direction control valve directing HP process air to said HP air chamber and simultaneously exhausting LP process air from said LP air chamber to thereby move said pistons in a first direction;

in said second condition (FIG. 6), said direction control valve directing LP process air from said HP air chamber to said LP air chamber to thereby reverse the movement of said pistons, and;

a pilot valve (60) responsive to alternating strokes of said pistons to alternate said first and second conditions of said direction control valve, to thereby sequentially reverse the direction of movement of said pistons.

2. A system as defined in claim 1, in which said HP air chamber is smaller in volume than said LP air chamber.

3. A two-stage fluid pump, including:

a high-pressure (HP) unit including a HP air chamber, fluid chamber, and piston therebetween;

a low pressure (LP) unit including a LP air chamber, fluid chamber, and piston therebetween;

said pistons connected to a common rod for reciprocating movement in unison;

an air direction control valve (50) disposed to receive input HP process air, said direction control valve operable alternately in first and second valve conditions;

in said first condition (FIG. 5), said direction control valve directing HP process air to said HP air chamber and simultaneously exhausting LP process air from said LP air chamber to thereby move said pistons in a first direction;

in said second condition (FIG. 6), said direction control valve directing LP process air from said HP air chamber to said LP air chamber to thereby reverse the movement of said pistons, and;

a pilot valve (60) responsive to alternating strokes of said pistons to alternate said first and second conditions of said direction control valve, to thereby sequentially reverse the direction of movement of said pistons.

4. A fluid pump as defined in claim 3, in which said HP air chamber is smaller in volume than said LP air chamber.

5. A fluid pump system, including high pressure (HP) and low pressure (LP) air-driven fluid pumps pneumatically connected in series;

(a) said HP pump (18) including left and right pump units (30, 40);

said left pump unit (30) including left air and fluid chambers (31, 32) and a piston (33) therebetween;

said right pump unit (40) including right air and fluid chambers (41, 42) and a piston (43) therebetween;

said pistons connected by a common piston rod (35) for reciprocating movement in unison;

an air direction control valve (50) disposed to receive input HP process air to said pump (18), said direction control valve operable alternately in first and second valve conditions;

in said first valve condition, said air direction control valve (50) directing process air to said left air chamber and exhausting process air from said right air chamber, thereby to move said pistons (33, 43) in a first direction;

in said second condition, said air direction control valve (50) directing process air to said right air chamber and exhausting process air from said left air chamber, thereby to move said pistons (33, 43) in a second direction opposite said first direction, and;

a pilot valve (60) responsive to alternating strokes of said pistons to alternate said first and second conditions of said direction control valve (50), to thereby sequentially reverse the direction of movement of said pistons;

(b) said LP pump (20) being similar to said HP pump (18), including left and right pump units, air direction control valve, and pilot valve to control said LP air direction control valve;

said LP pump (20) pneumatically connected to said HP pump (18) to receive process air exhaust from said HP pump as process air input to said LP pump.

* * * * *